United States Patent [19]

Gundlach et al.

[11] Patent Number: 4,591,713

[45] Date of Patent: May 27, 1986

[54] EFFICIENT, SELF-LIMITING CORONA DEVICE FOR POSITIVE OR NEGATIVE CHARGING

[75] Inventors: Robert W. Gundlach, Victor; Richard F. Bergen, Ontario, both of N.Y.

[73] Assignee: Xerox Corporation, Stamford, Conn.

[21] Appl. No.: 567,717

[22] Filed: Jan. 3, 1984

[51] Int. Cl.[4] ..... H01T 19/04

[52] U.S. Cl. ..... 250/326; 250/324

[58] Field of Search ..... 250/324, 325, 326; 361/230

[56] References Cited

U.S. PATENT DOCUMENTS

| | | | |
|---|---|---|---|
| 2,588,699 | 3/1952 | Carlson | 95/1.9 |
| 2,777,957 | 1/1957 | Walkup | 250/49.5 |
| 2,836,725 | 5/1958 | Vyverberg | 250/49.5 |
| 2,970,906 | 2/1961 | Bixby | 252/501 X |
| 3,396,308 | 3/1968 | Whitmore | 250/324 |
| 3,456,109 | 7/1969 | Gawron | 250/326 |
| 3,691,373 | 9/1972 | Compton et al. | 250/324 |
| 3,902,715 | 9/1975 | Hubler et al. | 271/243 |
| 3,909,614 | 9/1975 | Marshall | 250/324 |
| 4,086,650 | 4/1978 | Davis et al. | 361/229 |
| 4,156,141 | 5/1979 | Tolmie | 250/324 |
| 4,227,233 | 10/1980 | Nishikawa et al. | 250/324 |
| 4,322,156 | 3/1982 | Kohyama | 250/324 |
| 4,386,837 | 7/1983 | Ando | 250/325 |

FOREIGN PATENT DOCUMENTS 2013133 8/1979 United Kingdom .

*Primary Examiner*—Bruce C. Anderson

*Attorney, Agent, or Firm*—William A. Henry, II

[57] ABSTRACT

A miniaturized scorotron corona generator for charging a thin wire or a receiver surface includes a sawtooth coronode partially surrounded by a conductive shield with a control screen attached to the shield. The control screen is closely spaced to the receiver surface such that fringing fields between the screen and receiver surface contribute significantly both to efficient ion pumping and to potential leveling.

6 Claims, 3 Drawing Figures

B
24
80
20
C
A
22
10
25
F
70
75
72
41
61
44
46
30
31
78
43
50
42
60
E
D
73
40
45

PS 84
80
81
85
82
22

80
81
86
82
22

EFFICIENT, SELF-LIMITING CORONA DEVICE FOR POSITIVE OR NEGATIVE CHARGING

Reference is hereby made to copending application Ser. No. 490,824 entitled "Mini-Corotron" in the name of Richard Frank Bergen filed May 2, 1983, application Ser. No. 490,825 entitled "Self-Limiting Corotron" in the names of Robert William Gundlach and Richard Frank Bergen filed May 2, 1983 and application Ser. No. 567,608 entitled "Segmented Coronode Scorotron" in the name of Robert William Gundlach filed Dec. 30, 1983, which applications are incorporated herein by reference.

This invention relates to an efficient, compact corona device that can be adapted to charge a surface uniformly either positive or negative.

More particularly, this invention relates to a scorotron charging device that enables more uniform charging of photoreceptors with greater efficiency and stability, lower manufacturing and service costs, and decreased production of ozone and nitrate by-products, especially for negative charging.

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage the fields no longer drive ions to the receiver, but rather to the screen. Unfortunately, a low porosity screen intercepts most of the ions, allowing a very small percentage to reach the intended receiver. A more open screen, on the other hand, delivers charge to the receiver more efficiently, but compromises the control function of the device.

Further, problems with negative charging systems have historically been troublesome in charging a receptor uniformly. Some such systems involve the uses of wires, pins or sawteeth spaced at large distances from the receptor and thereby requiring high voltages. Charging units and power supplies, therefore, are relatively large and consume considerable space in, for example, a copying machine.

Other methods exist for trying to obtain uniform charging from negative charging systems such as dicorotron charging devices as shown in U.S. Pat. No. 4,086,650 that include glass coated wires and large specialized AC power supplies. A simpler system involves a screened corotron (scrotron). However, these methods are well known for being inefficient charging units, requiring slower charging speeds, and providing marginal uniformity.

Accordingly, in answer to the above-mentioned problems and in one aspect of the present invention there is provided a miniaturized scorotron charging system that is adaptable to charging a surface uniformly either positive or negative which includes a corona generating electrode of short radius, an insulating and partially open shield partially housing the electrode, a source of electrical potential being operatively connected to the electrode to cause the electrode to emit a corona discharge, the coronode being separated from a screen by 4 to 5 mm. The screen is spaced about 1.5 to 2 mm away from the surface to be charged. Impedance to the electrode (coronode) is provided to prevent arcing. The resistance should be selected to provide about a 10% drop in potential from the power supply to the electrode.

The foregoing and other features of the instant invention will be more apparent from a further reading of the specification and the claims and from the drawings in which:

While the invention will be described hereinafter in connection with a preferred embodiment, it will be understood that it is not intended to limit the invention to that embodiment. On the contrary, it is intended to cover all alternatives, modification and equivalents as may be included within the spirit and scope of the invention as defined by the appended claims.

Figure 1:
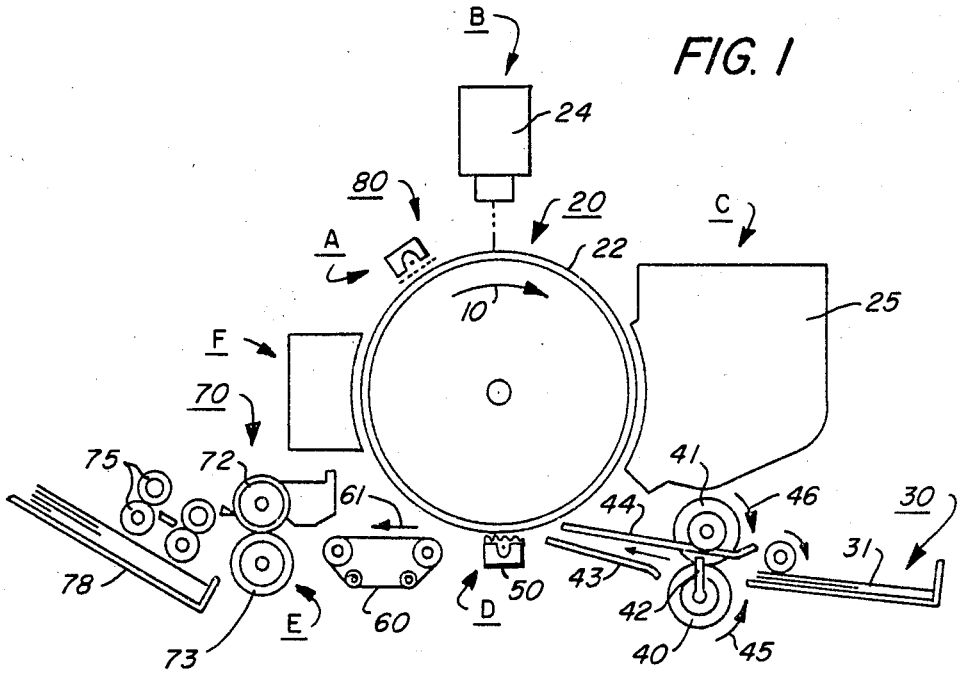
FIG. 1 is a schematic elevational view of an electrophotographic copying machine incorporating the features of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus of the present invention is disclosed as a means for charging a photosensitive member, it should be understood that the invention could be used in an electrophotographic environment as a pre-cleaning, transfer or detack device or any other apparatus in which uniform surface potential is desired or required.

Since the practice of electrophotographic copying is well known in the art, the various processing stations for producing a copy of an original document are represented in FIG. 1 schematically. Each process station will be briefly described hereinafter.

As in all electrophotographic copying machines of the type illustrated, a drum 20 having a photoconductive surface 22 entrained about and secured to the exterior circumferential surface of a conductive substrate is rotated in the direction of arrow 10 through the various processing stations. By way of example, photoconductive surface 22 may be made from selenium of the type described in U.S. Pat. No. 2,970,906. A suitable conductive substrate is made from aluminum.

Initially, drum 20 rotates a portion of photoconductive surface 22 through charging station A. Charging station A employs a corona generating device in accordance with the present invention, indicated generally by the reference numeral 80, to charge photoconductive surface 22 to a relatively high substantially uniform potential.

Thereafter drum 20 rotates the charged portion of photoconductive surface 22 to exposure station B. Exposure station B includes an exposure mechanism, indicated generally by the reference numeral 24, having a stationary, transparent platen, such as a glass plate or the like for supporting an original document thereon. Lamps illuminate the original document. Scanning of the original document is achieved by oscillating a mirror in a timed relationship with the movement of drum 20 or by translating the lamps and lens across the original document so as to create incremental light images which are projected through an apertured slit onto the charged portion of photoconductive surface 22. Irradiation of the charged portion of photoconductive surface 22 records an electrostatic latent image corresponding to the information areas contained within the original document.

Drum 20 rotates the electrostatic latent image recorded on photoconductive surface 22 to development station C. Development station C includes a developer unit, indicated generally by the reference numeral 25, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 25 is preferably a magnetic brush development system. A system of this type moves the developer mix through a directional flux field to form a brush thereof. The electrostatic latent image recorded on photoconductive surface 22 is developed by bringing the brush of developer mix into contact therewith. In this manner, the toner particles are attracted electrostatically from the carrier granules to the latent image forming a toner powder image on photoconductive surface 22.

With continued reference to FIG. 1, a copy sheet is advanced by sheet feeding apparatus 30 to transfer station D. Sheet feed apparatus 30 advances successive copy sheets to forwarding registration rollers 40 and 41. Forwarding registration roller 40 is driven conventionally by a motor (not shown) in the direction of arrow 45 thereby also rotating idler roller 41 which is in contact therewith in the direction of arrow 48. In operation, feed device 30 operates to advance the uppermost substrate or sheet from stack 31 into registration rollers 40 and 41 and against registration fingers 42. Fingers 42 are actuated by conventional means in timed relation to an image on drum 20 such that the sheet resting against the fingers is forwarded toward the drum in synchronism with the image on the drum. A conventional registration finger control system is shown in U.S. Pat. No. 3,902,715 which is incorporated herein by reference to the extent necessary to practice this invention. After the sheet is released by finger 42, it is advanced through a chute formed by guides 43 and 44 to transfer station D.

Continuing now with the various processing stations, transfer station D also includes an efficient corona generating device 50 in accordance with the present invention which applies a spray of ions to the back side of the copy sheet. This attracts the toner powder image from photoconductive surface 22 to the copy sheet.

After transfer of the toner powder image to the copy sheet, the sheet is advanced by endless belt conveyor 60, in the direction of arrow 61, to fusing station E.

Fusing station E includes a fuser assembly indicated generally by the reference numeral 70. Fuser assembly 70 includes a fuser roll 72 and a backup roll 73 defining a nip therebetween through which the copy sheet passes. After the fusing process is completed, the copy sheet is advanced by conventional rollers 75 to catch tray 78.

Invariably, after the copy sheet is separated from photoconductive surface 22, some residual toner particles remain adhering thereto. Those toner particles are removed from photoconductive surface 22 at cleaning station F. Cleaning station F includes a corona generating device (not shown) adapted to neutralize the remaining electrostatic charge on photoconductive surface 22 and that of the residual toner particles. The neutralized toner particles are then cleaned from photoconductive surface 22 by a rotatably mounted fibrous brush (not shown) in contact therewith. Subsequent to cleaning, a discharge lamp (not shown) floods photoconductive surface 22 with light to dissipate any residual electrostatic charge remaining thereon prior to the charging thereof for the next successive imaging cycle.

It is believed that the foregoing description is sufficient for purposes of the present application to illustrate the general operation of an electrophotographic copying machine. Referring now to the subject matter of the present invention, FIG. 2 depicts the corona generating device 80 in greater detail.

Figure 2:
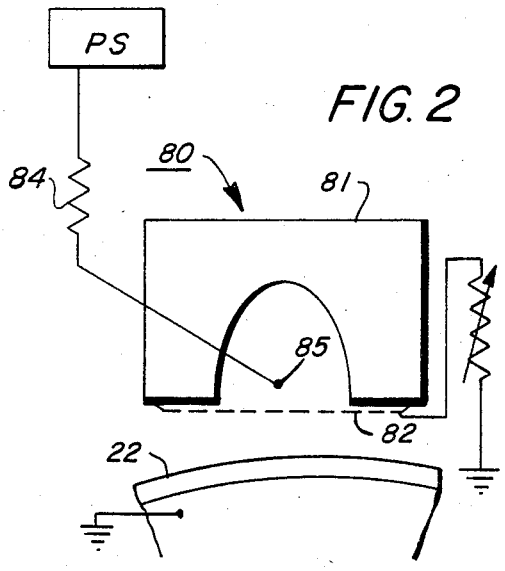
FIG. 2 is an enlarged side view of an embodiment of the self limiting scorotron unit that comprises the present invention.

Referring specifically to FIG. 2, the detailed structure and operation of an aspect of the present invention will be described. The corona generating scorotron unit, generally referred to as 80, is positioned above the photosensitive surface 22 and is arranged to deposit an electrical charge thereon as the surface 22 moves in a clockwise direction. The corona unit 80 includes an insulating shield 81 which partially encircles a substantial portion of corona generating electrode 85 that preferably comprises a 37 μm wire mounted transverse to the direction of movement of photoreceptor 20. A control screen 82 encloses the corona emitting wire 85 and is spaced from photoreceptor surfce 22. The corona electrode utilized in the present embodiment is connected to the negative terminal of the power source PS through a limiting resistor 84, whereby negative ion charges are placed on the photosensitive surface 22. However, it should be clear that an opposite polarity can be employed to obtain positive charge. Conventionally, as in U.S. Pat. No. 2,836,725 corona generators have been designed with a cross sectional area of 6 $cm^2$ square and use thin wire (90 μm) located about 6 mm from a shield surrounding the wire and about 12 mm from the receiver surface. Large power supplies for high charging voltages of near 7 kV with a 40 cm long wire are required for such devices in order to get a current of 88 μA or 2.2 μA/cm. In prior art scorotron devices, i.e., corona generators with control screens positioned between the corona wire and receiver, the screens are spaced a great distance (e.g. 12 mm) from the wire as well as the receiver surface.

An advantage of the close spacings of the present invention is being able to employ reduced high voltages ($\approx$5 kV). Thin wires 85 are employed, spaced from mesh screen 82 by about 3 to 5 mm. This compact scorotron system is successful at charging photoreceptors uniformly at speeds up to 25 cm/sec for each wire or channel. With 1.5 mm between the receiver and screen, electrometer measurements show −900 to −920 volts DC output range along a 25 cm length scorotron. The final surface potential at all points along the receiver surface indicates a totally stable −920 volts, the applied grid voltage, for a 25 cm/sec receiver speed. Thus, what is disclosed is the combination of a low radius corona emission surface, a tight screen for control (30–80% open, but preferably 65% open), and small screen-to-receiver spacing with sufficient impedance 84 to the coronode to prevent arcing. An insulating shield is also included with the aforementioned structure to provide uniform and efficient charging of a receiver surface. Screen 82 has a thickness of between 3→25 mils and preferably 3→5 mils. It has been found that screen efficiency shows excellent inverse correlation with thickness.

The low radius coronode with voltage control (scorotron) screen is placed close enough to photoreceptor 20 that fringing fields between screen 82 nd photoreceptor surface 22 contribute to efficient ion pumping or flow as well as potential leveling on photoreceptor surface 22. It has been found that 1.5 mm is a good trade-off between better "pumping action" (fringing fields) and critical spacing tolerances. This charging device is capable of AC charge or discharge and is ideal for color copying where a maximum charging speed can be compromised in order to obtain a very precise, uniform level of potential, and where tone reproduction makes charge uniformity even more critical.

In another aspect of the present invention, charging unit 80 is adapted to be highly efficient. The plastic non-conductive shield 81 allows ions from the high voltage coronode to go toward screen 82 which is at the desired charging potential of the photoreceptor surface 22. As a result, the ions from coronode 85 are not conducted by the shield but emitted toward the screen, instead. As they approach the plane of the screen, the ions are driven by more localized fringing fields through the holes of the screen and onto the photoreceptor surface. As the potential of the photoreceptor surface builds up to the voltage applied to the screen, the fringing fields collapse and the field lines from the coronode terminate on the screen, thereby driving the ions to the screen and limiting the photoreceptor surface to that potential. This gives an efficiency of between 30–50% and at times up to 80%. Using this scorotron system with positive charging is considered within the scope of the present invention, although it is not as essential in most positive charging applications, since corona emission from positive wire coronodes tends to be more uniform by nature. In the past, the relatively large scorotron units have employed a high percentage of open areas within the screen. Conductive shields were required because of the large spacing and high percentage openings, to keep the corona wires above threshold. However, with corona generator 80 the coronode is separated from a 65% open screen by approximately 3 mm. The screen has a fixed voltage applied to it so the coronode can be kept above threshold due to the proximity and area of the biased screen; therefore a conductive shield is not necessary to maintain corona. For example, a charging unit such as 80 that has a 12 mm wide channel operated without change in coronode current, as an insulating shield was brought to within 6 mm above the coronode wire, and with the wire spaced 3 mm above the screen.

Figure 3:
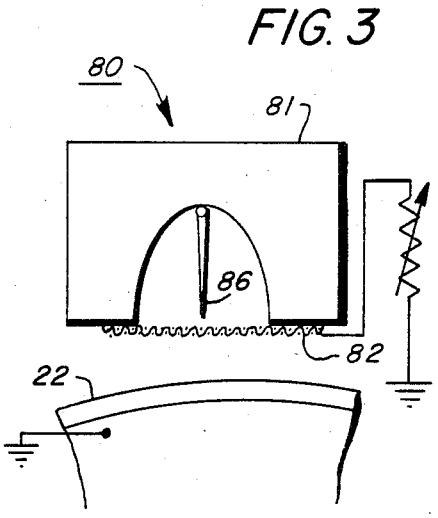
FIG. 3 is an enlarged side view of another embodiment of the self limiting scorotron unit of the present invention.

In FIG. 3, an embodiment of the present invention is shown that comprises sawteeth 86 of Beryllium copper on 3 mm centers. The sawteeth are spaced from mesh screen 83 by about 5 mm. The spacing between the mesh screen and photoreceptor 22 is about 1.5 mm. This embodiment substantially reduces ozone production when charging takes place. The sawteeth are enclosed in an insulating housing 81 and are energized by a conventional electrical potential source, as is screen 83. Voltage control screen 83 is positioned close enough to the receiver to produce fringing fields until the receiver potential reaches that of the screen, thereby providing high efficiency and good control of the potential on the photoreceptor surface.

While the invention has been described with reference to the structure herein disclosed, it is not confined to the details as set forth and is intended to cover any modifications and changes that may come within the scope of the following claims.

What is claimed is:

1. A compact self-limiting and highly efficient scorotron device adapted to apply a uniform charge to a photoconductive surface, comprising:

a non-conductive shield;

a coronode wire positioned within said shield and adapted to give off corona emissions when energized;

a low voltage power source adapted to supply energy to said coronode wire;

a screen placed between said coronode wire and said photoconductive surface, said screen being sufficiently close to said photoconductive surface that fringing fields between said screen and said photoconductive surface contribute to efficient ion pumping as well as potential leveling on said photoconductive surface; and and impedance means connected to said wire to prevent arcing.

2. The self-limiting scorotron device of claim 1, wherein said screen is positioned about 1.5 mm away from said photoconductive surface.

3. The self-limiting scorotron of claim 1, wherein said screen has about 30–65 percent open areas and a thickness of about 3–5 mils.

4. The self-limiting scorotron device of claim 1, wherein said non-conductive shield is plastic and said screen is maintained at the desired charging potential so that ions from said coronode wire are not conducted by said shield but emitted toward said screen and as they approach the plane of the screen are driven by localized fringing fields through said screen and onto said photoconductive surface, whereby as the potential of said photoconductive surface builds up to said screen charging potential the fringing fields collapse and the field lines from said coronode wire terminate on said screen thereby driving the ions to said screen and limiting the photoconductive surface to that potential.

5. The self-limiting scorotron device of claim 2, wherein said screen has about 65 percent open areas and is spaced about 3 mm from said coronode wire.

6. A compact self-limiting and highly efficient scorotron device adapted to apply a uniform charge to a photoconductive surface, comprising:

a non-conductive shield;

a sawtooth coronode positioned within said shield and adapted to give off corona emissions when energized;

a low voltage power source adapted to supply energy to said sawtooth coronode; and a screen placed between said sawtooth coronode and said photoconductive surface, said screen being sufficiently close to said photoconductive surface that fringing fields between said screen and photoconductive surface contribute to efficient ion pumping as well as potential leveling on said photoconductive surface.

* * * * *